US005301882A

United States Patent [19]

Morikawa et al.

[11] Patent Number: 5,301,882

[45] Date of Patent: Apr. 12, 1994

[54] CONCRETE CRUSHER

[75] Inventors: Sumio Morikawa, Sakai; Nobuyuki Zakoji, Toyonaka, both of Japan

[73] Assignee: Ohyodo Diesel Co., Ltd., Osaka, Japan

[21] Appl. No.: 829,831

[22] Filed: Feb. 3, 1992

[30] Foreign Application Priority Data

Aug. 27, 1991 [JP] Japan ..... 3-76287

[51] Int. Cl.[5] ..... B02C 1/10

[52] U.S. Cl. ..... 241/101.7; 30/134; 241/263

[58] Field of Search ..... 241/101.7, 263-269, 241/291; 30/134, 135; 414/739, 740; 144/34

[56] References Cited

U.S. PATENT DOCUMENTS 4,776,524 10/1988 Sakato ..... 241/101.7

*Primary Examiner*—Douglas D. Watts

*Attorney, Agent, or Firm*—Millen, White, Zelano & Branigan

[57] ABSTRACT

The present invention provides a concrete crusher comprising an upper jaw and a lower jaw which are connected to each other through a pivot pin and adapted to be opened and closed by a hydraulic cylinder, the lower jaw having a plurality of longitudinal cutters extending perpendicular to the pivot pin and arranged in the form of a fork, the upper jaw having a large rough cutter extending perpendicular to the pivot pin, the lower jaw further having a plurality of cross cutter bars arranged in a grate-like pattern avoiding the position of descent of the large rough cutter, the upper jaw further having a surfacing plate member facing the lower jaw and having a plurality of cross cutter bars corresponding to the cross cutter bars of the lower jaw, with the large rough cutter interposed between rows of the cross cutter bars of the upper jaw.

3 Claims, 2 Drawing Sheets

CONCRETE CRUSHER

FIELD OF THE INVENTION

The present invention relates to a concrete crusher.

BACKGROUND OF THE INVENTION

In the demolition of buildings and other structures, crushing of concrete is generally carried out using a chisel (teeth) device which is opened and closed by a hydraulic jack. Known as a concrete crusher, this device comprises a pair of jaws for biting concrete as secured to the free end of the driving arm of a construction machine, typically a power shovel, a hydraulic cylinder for opening and closing said jaws, and chisel or crushing means attached to the mating faces of the jaws.

In order that the crushing capacity of such a concrete crusher may be increased, it is important to insure that the output of the hydraulic cylinder will act on the crushing chisel means as a concentrated load and also that, in consideration of the fact that concrete is rather resistant to compressive forces, the crushing force will act not as a compressive force but as a bending moment. Several proposals have been made in accordance with the above deign concepts.

For example, it was proposed to provide the mating faces of a pair of jaws with crushing means each comprising a plurality of projecting bars arranged in parallel with a pivot pin but in staggered relation between the jaws so that the output of a hydraulic cylinder may act as a concentrated load and, at the same time, exert bending moments on the concrete (Japanese Patent Publication No. 58-14909).

It was also proposed to provide a pair of jaws, with the lower jaw having on its mating face a plurality of longitudinal cutters arranged in the form of a fork and perpendicular to a jaw pivot pin and a plurality of auxiliary cutters as arranged between said longitudinal cutters and perpendicular to the latter to constitute a grate-like cutter system, while the upper jaw is provided on its mating surface with a large sharp-pointed rough crushing cutter perpendicular to said pivot pin and a plurality of sharp-pointed cutters (chisels) directed against said grate-like cutting system of the lower jaw. In this arrangement, a concentrated load is applied to the large rough crushing cutter to rough-cut the concrete in the first place and, then, bending moments are applied to the concrete by means of the grate-like cutting system of the lower jaw and the chisels of the upper jaw (Japanese Patent Publication No. 1-27504).

It has also been proposed to provide a concrete crusher such that, in the crusher arrangement proposed in said Japanese Patent Publication No. 1-27504, said large rough-cutting tool is omitted and, instead, the upper jaw is provided with a multiplicity of chisels corresponding to the meshwork of the grate-like cutting system of the lower jaw (Japanese Kokai Patent Application No. 60-113258, Japanese Utility Model Publication No. 61-28839).

However, in all of the crashers referred to above, the cutters are arranged in staggered relation so that bending moments may act on the concrete to achieve an improved crushing effect but the crushing cutters tend to be worn rapidly just because they act to produce bending moments and particularly if the cutters are chisels, they must be replaced at short intervals.

OBJECTS AND SUMMARY OF THE INVENTION

It is, therefore, an object of the invention to provide a concrete crusher having an improved concrete crushing efficiency.

It is another object of the invention to provide a concrete crusher which is sturdy and easy to maintain.

It is a still further object of the invention to provide a concrete crusher which can be manufactured at low cost.

To accomplish the above objects, the invention provides a concrete cutter comprising an upper jaw and a lower jaw which are connected to each other through a pivot pin and adapted to be opened and closed by a hydraulic cylinder, said lower jaw having a plurality of longitudinal cutters extending perpendicular to said pivot pin and arranged in the form of a fork, said upper jaw having a large rough cutter extending perpendicular to said pivot pin, said lower jaw further having a plurality of cross cutter bars arranged in a grate-like pattern avoiding the position of descent of said large rough cutter, said upper jaw further having a surfacing plate member facing said lower jaw and having a plurality of cross cutter bars corresponding to said cross cutter bars of the lower jaw, with said large rough cutter interposed between rows of said cross cutter bars of the upper jaw.

DETAILED DESCRIPTION OF THE PREFERRED EMBODIMENT

Figure 1:
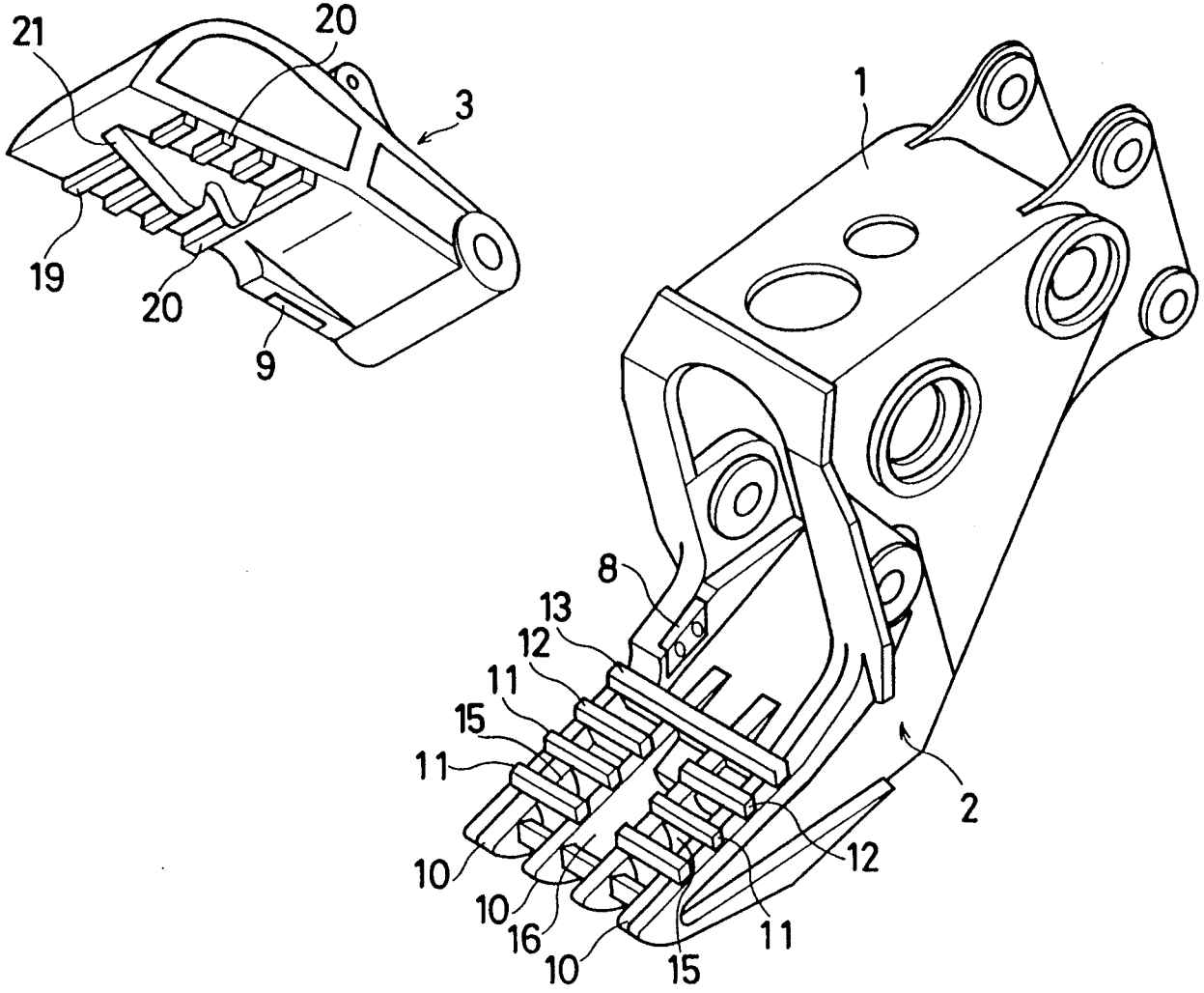
FIG. 1 is a disassembled perspective view showing an embodiment of the invention.
Figure 2:
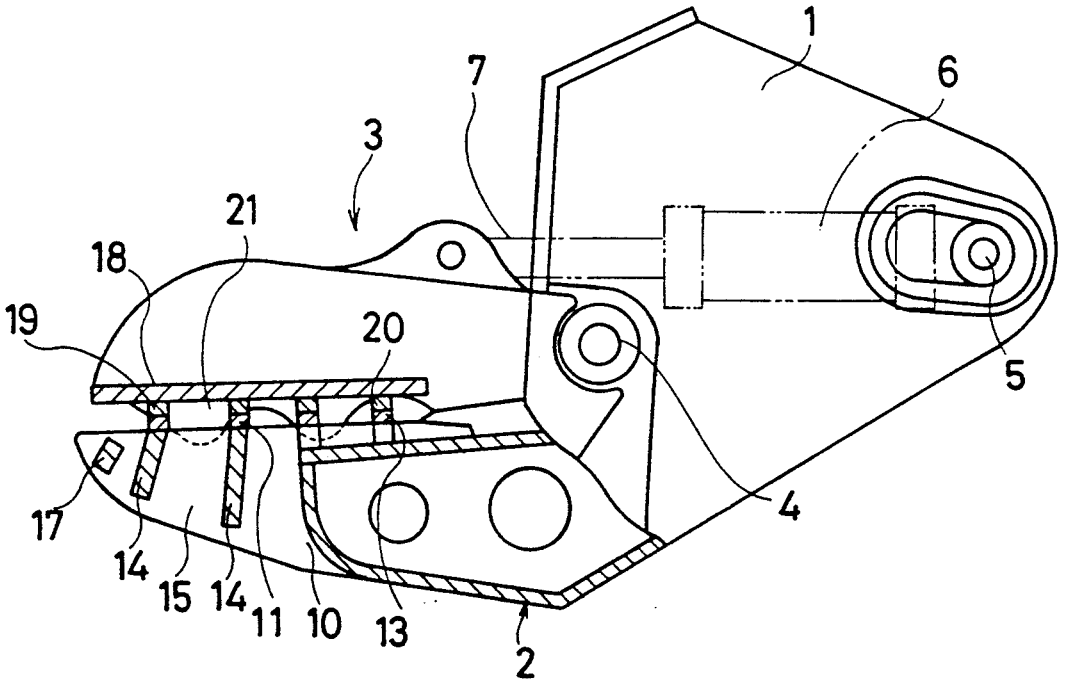
FIG. 2 is a side-elevation view, in partial section, of the same embodiment.

The constitution and operation of the invention are now described in detail with reference to the accompanying drawings;

The illustrated embodiment is relevant to an attachment-type concrete crusher having a reinforcement cutter for fine fragmentation of concrete which can be detachably secured to the free end of the driving arm of a power shovel. The illustrated crusher has a tip opening width of 850 mm, an upper jaw width of 330 mm and a lower jaw width of 560 mm, and has a tip crushing capacity of 80 tons.

The reference numeral 1 indicates a crusher housing which is integrally formed with a lower jaw 2. The lower jaw 2 is, therefore, stationary. Juxtaposed with this lower jaw 2 is a movable upper jaw 3 which is swingably supported by a pivot pin 4 traversing the housing 1. Connected to the upper side of this upper jaw 3 is a piston rod 7 of a hydraulic cylinder 6 which is mounted through a connecting pin 5 within said housing 1. Therefore, as this hydraulic cylinder 6 is actuated by the hydraulic pressure from a hydraulic oil pump (not shown) mounted on a power shovel (not shown), the upper jaw 3 is opened or closed with respect to the lower jaw 2. Furthermore, the inner base portion of the lower jaw 2 is provided, on one side thereof, with a lower reinforcement cutter 8, while the upper jaw 3 is equipped with an upper reinforcement cutter 9 in the corresponding position for cooperative shear operation.

While the foregoing is the arrangement adopted in the conventional concrete crushers as well, the concrete crusher of this embodiment is further provided with the crushing cutter means described below.

Thus, the lower jaw 2 is provided with four longitudinal cutters 10,10 . . . arranged in the form of a fork and perpendicular to said pivot pin 4. Respectively disposed on pairs of adjacent longitudinal cutters 10,10 and 10,10, which are located on the right-hand and left-hand sides as viewed, are short cross cutters 11 and 11 which are steel bars of rectangular section. In addition, short cross cutters 12 are disposed on the longitudinal cutters 10,10 . . . as illustrated. Further disposed on said longitudinal cutters 10,10 . . . , in a position closer to their bases and transversing all the four longitudinal cutters 10,10 . . . , is a single elongated cross cutter 13. Disposed under said short cross cutters 11,11 are span members 14 spanning the longitudinal cutters 10,10 . . . for added rigidity. The span members 14 serve, also, as guides for letting out crushed concrete. Thus, the longitudinal cutters 10,10 . . . and short cross cutters 11 constitute a grate-like cutter system. However, because of the absence of short cross cutters 11 between the middle two longitudinal cutters 10,10, there is formed a rectangular through-opening which is larger than the grate 15 of said grate-like cutter system.

The longitudinal cutters 10,10 . . . , cross cutters 11,12,13 and span members 14 are rectangular bars of high tension steel and, when worn, the short and long cross cutters 11, 12 and 13, in particular, can be easily replaced with new ones by welding. The forward end of each longitudinal cutter 10 is pointed and only span members 17 are interposed in the forward end portion of the lower jaw, without provision of any cross cutter, so as to assist in scooping of concrete.

The upper jaw 3 has a plate member 18 constituting its side facing the lower jaw 2 and this plate member 18 is provided with short and long cross cutters corresponding to said short and long cross cutters 11, 12 and 13 of the lower jaw 2. In addition, a longitudinally elongated rough cutter 21 is interposed between rows of said short cross cutters 19,19 . . . Therefore, as the upper and lower jaws 3,2 are closed, said short and long cross cuter bars 11,12,13 and said cutter bars 19 . . . and 20 are abutted against each other and the opening 16.

The operation of this embodiment is now described. With the upper and lower jaws 3,2 in the open position, the concrete is scooped up by the forward ends of the longitudinal cutters 10. Then, as the upper and lower jaws 3,2 are closed, the large rough cutter 21 crushes the concrete into coarse fragments to reduce the crushing resistance in the subsequent crushing operation. Then, the upper and lower cross bars 11,12,13 and 19,20 crush the coarse concrete fragments into finer fragments. Since the upper and lower cross cutters 11,12,13 and 19,20 are abutted against each other, the bending moments characteristic of staggered chisels are not obtained but inasmuch as the concrete has already been broken into coarse fragments, a high crushing efficiency is insured. The resulting fine fragments of concrete fall through the grates 15 and through-opening 16 as well as along the lateral sides of the upper and lower jaws 3,2 but since the short cross cutters 19 of the upper jaw 3 do not fit into the grates 15, the finely divided concrete is allowed to fall readily, with the result that the short cross cutters 19, . . . do not encounter any remarkable resistance of the crushed concrete.

It should be understood that while the cross cutters in the above embodiment were constituted by rectangular bars, bars of other configurations can also be employed.

Thus, in accordance with the present invention wherein the mating faces of the upper and lower jaws are provided with projecting cross bars which are abutted against each other on closure of the jaws, the concrete is crushed by mere contact of these cross cutters but since the concrete is first split by a large rough cutter, the crushing of concrete proceeds easily, without undue forces acting on the cross bars, thus insuring a long service life. Moreover, since the cross bars are mere steel bars, they can be easily replaced with new ones at low cost.

What is claimed is:

1. A concrete crusher comprising an upper jaw and a lower jaw which are connected to each other through a pivot pin and adapted to be opened and closed by a hydraulic cylinder, said lower jaw having a plurality of longitudinal cutters extending perpendicular to said pivot pin and arranged in the form of a fork, said upper jaw having a large rough cutter extending centrally on a surfacing plate member and perpendicular to said pivot pin, said lower jaw further having a plurality of short cross cutter bars disposed on said longitudinal cutters in the form of a grate-like pattern avoiding the position of descent of said large rough cutter and a long cross cutter bar disposed on and transversing all of said longitudinal cutters at a position rearwardly spaced from and parallel to said short cross cutter bars, said upper jaw having on said surfacing plate member a plurality of short cross cutter bars corresponding to said short cross cutter bars of the lower jaw on either side of said large rough cutter and a long cross cutter bar corresponding to said long cross cutter bar of the lower jaw, said short and long cross cutter bars of the lower jaw projecting from a plane defined by said longitudinal cutters and said short and long cross cutter bars of the upper jaw projecting from said surfacing plate member so that they abut against each other when the lower and upper jaws are fully closed, and said cross cutter bars being replaceable when worn by new cross cutter bars welded in place.

2. The concrete crusher of claim 1, further including span members disposed in spaced relation to one another between said longitudinal cutters of said lower jaw.

3. The concrete crusher of claim 1, wherein the cross-cutter bars are rectangular in cross-section.

* * * * *